United States Patent [19]

Hayes

[11] Patent Number: 5,056,819

[45] Date of Patent: Oct. 15, 1991

[54] SKI POLE STRAP

[75] Inventor: Bernard Hayes, Ridgewood, N.J.

[73] Assignee: Polecat Enterprises, Inc., Ridgewood, N.J.

[21] Appl. No.: 476,796

[22] Filed: Feb. 8, 1990

Related U.S. Application Data

[63] Continuation-in-part of Ser. No. 384,453, Jul. 21, 1989.

[51] Int. Cl.[5] ..... A63C 11/00

[52] U.S. Cl. ..... 280/809; 224/250; 224/917; 280/814; 280/820

[58] Field of Search ..... 280/814, 820, 809; 224/219, 220, 221, 222, 250, 267, 917; D21/230

[56] References Cited

U.S. PATENT DOCUMENTS 3,543,977 12/1970 Lockridge ..... 224/250
4,120,437 10/1978 Hara ..... 280/814
4,833,901 5/1989 Sage et al. ..... 280/814
4,852,931 8/1989 Ferdi ..... 280/814

*Primary Examiner*—Andres Kashnikow
*Assistant Examiner*—Eric Culbreth
*Attorney, Agent, or Firm*—Weingram & Zall

[57] ABSTRACT

The present invention includes a fastener strap comprised of a length of fabric having end sections which can be fastened together to create a loop. Intermediate the end sections on the interior surface of the loop, there is a fastener affixed thereto. This intermediate fastener cooperates with corresponding fasteners which are affixed to ski poles or other articles to be supported. The size of the loop is such that the mounting of the poles onto the intermediate fastener leaves a loop of material remaining which can be utilized as a hook or a handle to otherwise support or carry the poles in the fastener strap of the invention.

3 Claims, 3 Drawing Sheets

SKI POLE STRAP

This application is a Continuation-In-Part application of my co-pending application, Ser. No. 07/384,453, filed July 21, 1989, the entire disclosure of which is incorporated herein by reference.

BACKGROUND OF THE INVENTION

This invention relates to a fastener strap for use by a skier. The fastener is employed by the skier in a variety of ways to, generally, enable the skier to be free of concern about the need to hold or otherwise support ski poles. The fastener may be either wrapped around ski poles and skis to hold them together during transport or wrapped around the poles alone enabling them to be supported by a portion of a chair lift so that the skier does not have to otherwise hold or support the poles.

As is well known, skiers have to deal with a number of items of equipment, namely ski poles, skis, gloves, goggles, hat, ear protectors and other cold weather protective equipment. It is often cumbersome to handle all of these items.

The present invention enables the skier to fasten a pair of ski poles together in a "bundle". The "bundle" of poles can be carried or supported on, for example, the ski lift, as a single unit. Further, the skis and the poles can be "bundled" together and all four items can be transported or stored as a single unit.

To enhance its use, the poles themselves may have a fastener element (e.g. Velcro) affixed to the poles for cooperating with a mating fastener formed on the strap.

The known prior art does not teach or suggest a device which performs the functions of applicant's invention.

SUMMARY OF THE INVENTION

The present invention includes a fastener strap comprised of a length of fabric having end sections which can be fastened together to create a loop. Intermediate the end sections on the interior surface of the loop, there is a fastener affixed thereto. This intermediate fastener cooperates with corresponding fasteners which are affixed to ski poles or other articles to be supported. The size of the loop is such that the mounting of the poles onto the intermediate fastener leaves a loop of material remaining which can be utilized as a hook or a handle to otherwise support or carry the poles in the fastener strap of the invention.

BRIEF DESCRIPTION OF THE DRAWINGS

These as well as further objects and advantages of the invention will become apparent to those skilled in the art from a review of the following detailed specification, reference being made to the accompanying drawings in which.

DETAILED DESCRIPTION OF THE INVENTION

Figure 1:
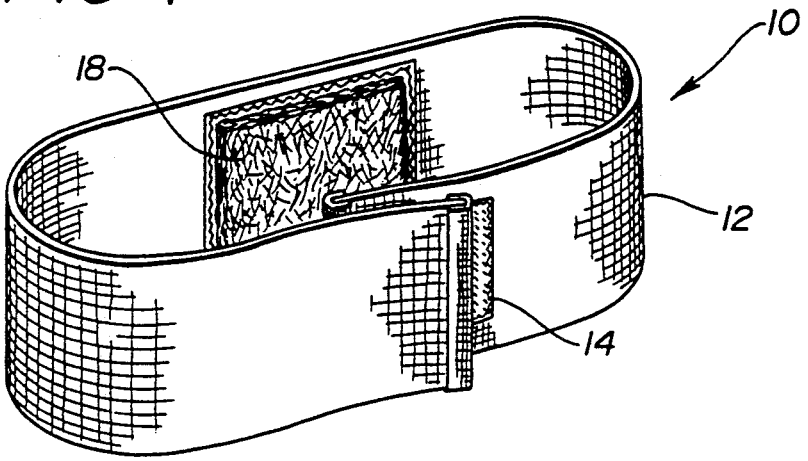
FIG. 1 is a perspective view of the invention.
Figure 2:
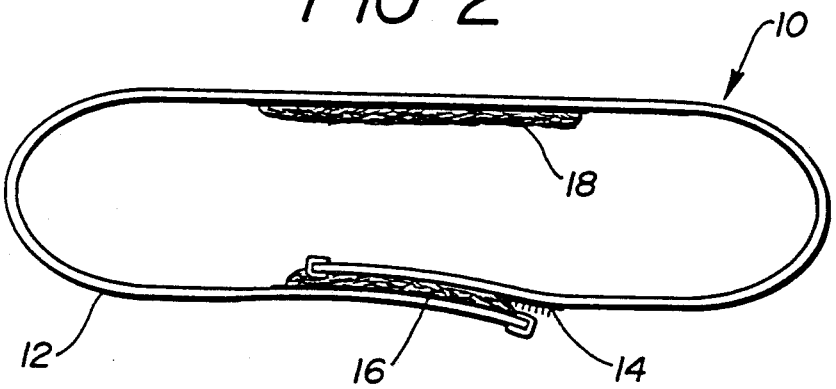
FIG. 2 is a top plan view of the invention.
Figure 3:
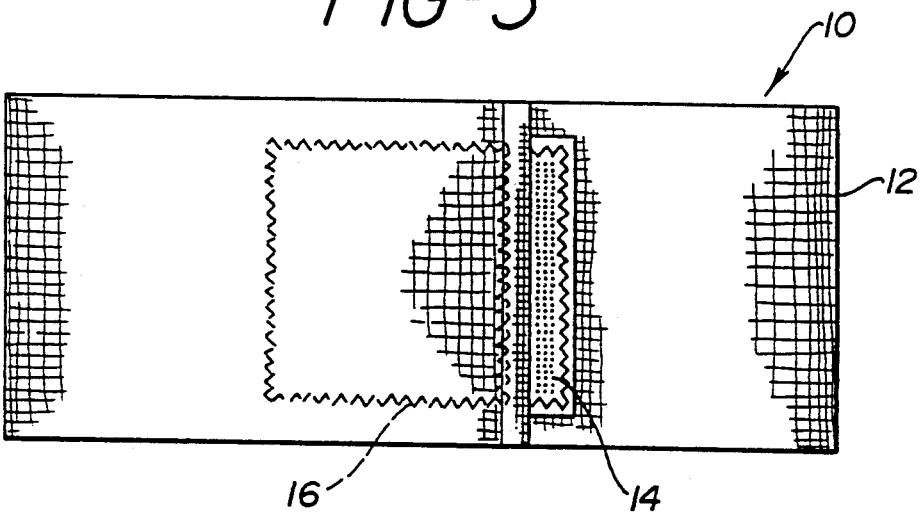
FIG. 3 is a front elevational view of the invention.
Figure 4:
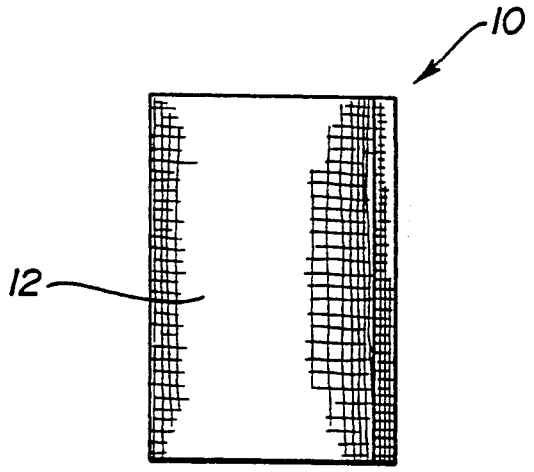
FIG. 4 is a left side elevational view of the invention.
Figure 5:
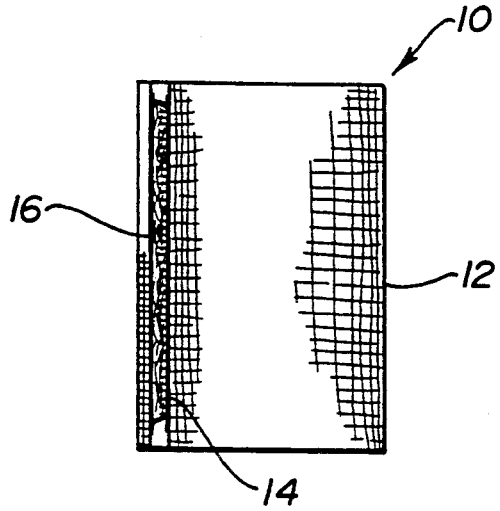
FIG. 5 is a right side elevational view of the invention.
Figure 6:
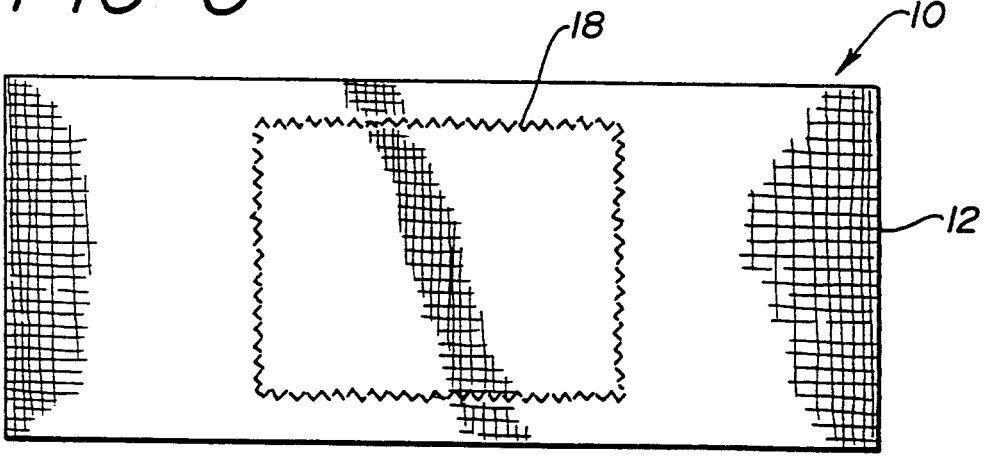
FIG. 6 is a rear elevational view of the invention.

As shown in FIGS. 1–7, the ski pole fastener strap 10 of this invention comprises a length of fabric 12 having thereon end sections 14,16 of hook and pile fabric, e.g., VELCRO brand, which interlock with each other and a hook or pile midsection 18. More specifically, the strap 10 comprises a length of fabric 12 having at one end and on one side of the fabric 12 (e.g. sewed thereon), a hook section of fabric 14, and at the other end and other side a pile section of fabric 16 (e.g. sewed thereon). Midway between the end sections is a hook or pile midsection 18 (e.g. sewed thereon). Each of the ski poles 20,22 (FIG. 7) has along its length a hook or pile section 24,26 which mates with the hook or pile midsection 18. Preferably, the midsection 18 is a pile section and sections 24,26 are adhesively attached to the ski pole 20,22 and are hook sections.

Figure 7:
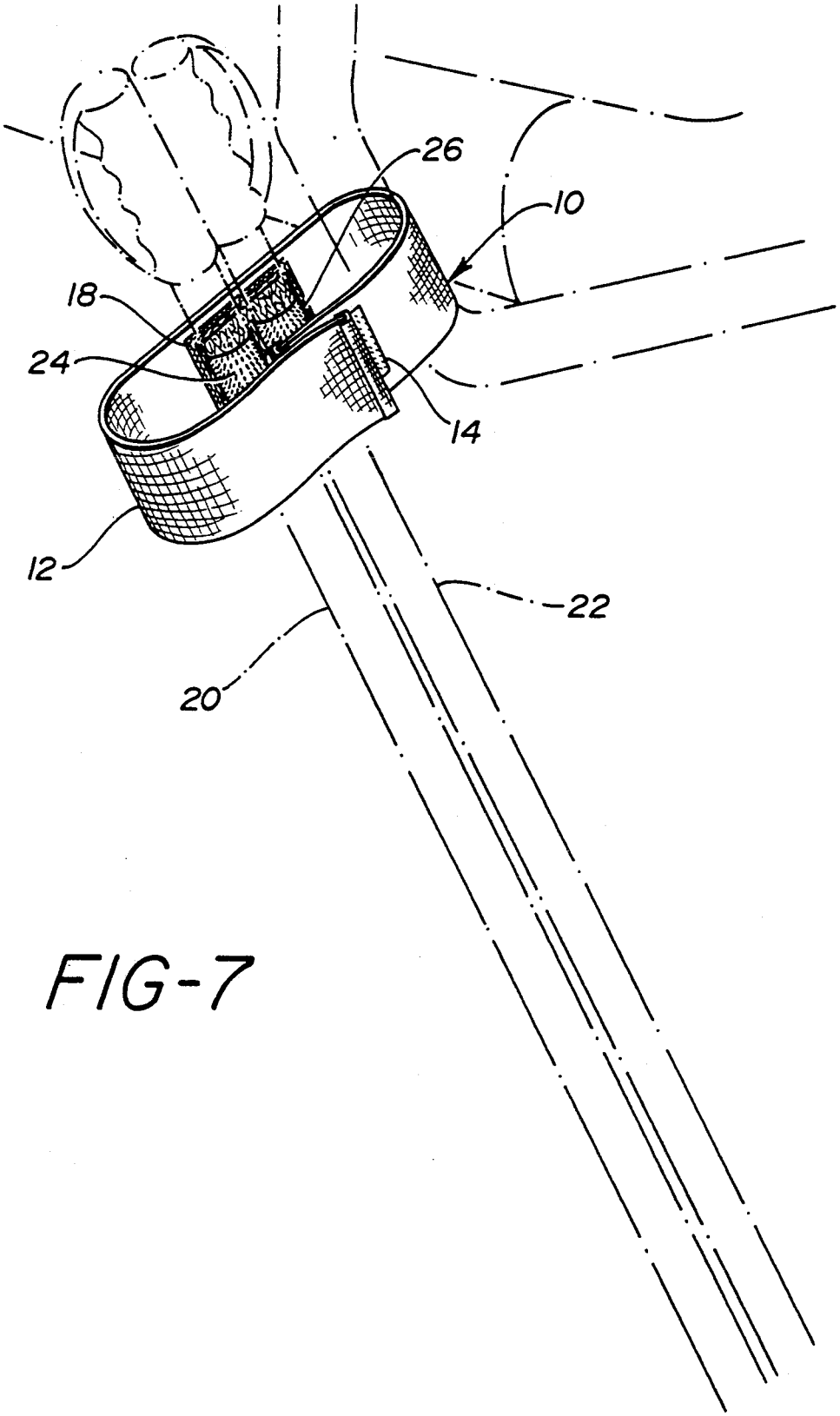
FIG. 7 is a perspective view of the invention in use.

Referring to FIG. 7, in use the pile midsection 18 is attached to hook sections 24,26 which are adhesively attached to ski poles 20 and 22. The strap 10 is then wrapped around, for example, a portion of the ski lift (phantom lines), and the hook and pile end sections 14,16 fastened together. When not in use, the strap 10 may be wrapped around the arm and the end sections 14,16 fastened to each other to maintain the strap 10 closed. Optionally, the strap 10 may be wrapped around the poles and skis (not shown), the strap 10 attaching to the poles 20,22, to hold them securely together during transport and/or non use, with the midsection 18 of the strap 10 hooking to the sections 24,26 on the poles 20,22 and the end sections 14,16 mating together.

Preferably the strap 10 and sections 20,22 are packaged together for sale. Such a combination comprises a length of flexible material having first and second surfaces and first and second ends; a hook or pile fastening element on the first end and surface; a hook or pile fastening element on the second end and surface; a hook or pile fastening element on the second surface intermediate the first and second ends; and a pair of hook or pile fastener elements for fastening to the fastener element intermediate the ends having hook or pile on one surface and an adhesive attachment means on the other surface for attachment of the fastener elements to a pair of ski poles.

To assemble, place an adhesive backed hook section 24,26 on each ski pole 20,22 about one-third of the total length of the pole below the handle. Align sections 24,26 with pile midsection 18 on the strap 10, and then wrap the strap 10 around, for example, the ski lift bar, attaching ends 14,16 together. After the lift ride, detach ends 14,16 from each other and unfasten the strap 10 from poles 20,22.

As modifications to the foregoing may be made without departing from the spirit and scope of my invention, what is sought to be protected is set forth in the appended claims.

I claim:

1. Ski poles and a fastener strap therefore, comprising:

a fastener strap comprising:

a length of flexible material having first and second surfaces and first and second ends;

a hook fastening element on the first end and first surface;

a pile fastening element on the second end and second surface;

an intermediate fastening means on the second surface intermediate the first and second ends; and ski poles, each having a pole fastener element attached thereto which engages the intermediate fastener means, wherein each of the pole fastener elements engages with the fastener strap, within a loop formed by the attachment of the first and second ends of the fastener strap, to fasten the ski poles to the fastener strap.

2. The ski poles and fastener strap therefore of claim 1 wherein the intermediate fastening means comprises an element of a hook and pile attachment means.

3. The ski poles and fastener strap therefore of claim 1 wherein the pole fastener elements comprise a length of material having on one surface thereof an adhesive attachment means for attaching to the ski poles and on the other surface a fastening means for engagement with the intermediate fastening means for attachment to the fastener strap.

* * * * *